US005807087A

United States Patent [19]

Brandt et al.

[11] Patent Number: 5,807,087

[45] Date of Patent: Sep. 15, 1998

[54] STATOR ASSEMBLY FOR A PROGRESSING CAVITY PUMP

[75] Inventors: David Christopher Brandt, Claremore; Gene Ray Neil Fulbright, Catoosa, both of Okla.

[73] Assignee: Tarby, Inc., Claremore, Okla.

[21] Appl. No.: 822,414

[22] Filed: Mar. 21, 1997

[51] Int. Cl.[6] ..... F04C 2/107; F04C 5/00

[52] U.S. Cl. ..... 418/48; 418/153

[58] Field of Search ..... 418/5, 39, 48, 418/153; 29/888.023

[56] References Cited

U.S. PATENT DOCUMENTS

| | | | |
|---|---|---|---|
| 3,652,192 | 3/1972 | Kramer et al. | 418/125 |
| 3,802,803 | 4/1974 | Bogdanov et al. | 417/211.5 |
| 3,912,426 | 10/1975 | Tschirky | 418/48 |
| 3,982,858 | 9/1976 | Tschirky | 418/48 |
| 4,104,009 | 8/1978 | Chanton | 418/48 |
| 4,207,037 | 6/1980 | Riordan | 418/48 |
| 4,211,521 | 7/1980 | Streicher | 418/48 |
| 4,711,006 | 12/1987 | Baldenko et al. | 29/156.4 R |
| 5,417,281 | 5/1995 | Wood et al. | 166/68 |

FOREIGN PATENT DOCUMENTS

| | | | |
|---|---|---|---|
| 1084489 | 4/1984 | U.S.S.R. | 418/48 |

OTHER PUBLICATIONS

Mono Merlin Pump Family Brochure by by Mono Pumps Limited, Nov. 1991.

Mono Merlin Monobloc Pump Range Technical Data Sheet No. 8001/005 by Mono Pumps Limited, Jul. 1986.

*Primary Examiner*—John J. Vrablik

*Attorney, Agent, or Firm*—Fellers, Snider, Blankenship, Bailey & Tippens, P.C.

[57] ABSTRACT

A stator assembly is provided for use in a progressing cavity pump. The assembly includes a tubular pump barrel in which are slidably positioned a plurality of cup-like spacers. Each spacer has a tubular wall, an inlet end with an internal annular flange and an outlet end defined by a circumferential edge of the tubular wall. An elastomeric stator segment is housed in each spacer. Each stator segment has adjacent an outlet end thereof a circumferential external lip portion and has a contoured cavity therethrough generally coaxial with the pump barrel and adaptable to rotatably receive a progressing cavity pump rotor therein. The lip portion of each stator segment is captured between a spacer outlet end circumferential edge and the next adjacent spacer annular flange portion so that the elastomeric stator segments are retained in serial position within the pump barrel by the spacers permitting the spacers and stator segments to be easily removed from the pump barrel for repair and replacement.

9 Claims, 3 Drawing Sheets

STATOR ASSEMBLY FOR A PROGRESSING CAVITY PUMP

REFERENCE TO PENDING APPLICATIONS

This application is not related to any pending applications nor is it referenced in a microfiche appendix.

BACKGROUND OF THE INVENTION

A progressing cavity pump is a positive displacement pump particularly adaptable for pumping viscous, abrasive or corrosive liquids. Rene J. L. Moineau is credited with creating the progressing cavity pump concept in 1932. Such pumps are occasionally referred to as single screw pumps. This name arises since the rotor of a typical progressing cavity pump is a single helix which rolls eccentrically in a stator forming a double helix. This single helix rotor/double helix stator combination creates pockets or cavities which are moved (progressed) linearly from an inlet end to a discharge end of the pump as the rotor is turned.

Applications for progressing cavity pumps fall into two general categories, that is, metering or liquid transfer. Progressing cavity pumps function exceptionally well for metering purposes since they deliver a highly reliable predetermined quantity of liquid for each revolution of the pump rotor. By accurately governing the rate of revolution of the pump rotor, the quantity of liquid delivered by a progressing cavity pump can be accurately repeated. For this reason, progressing cavity pumps are frequently employed in chemical processing systems wherein accurate proportional blending or mixing of liquid components is required.

The other basic application for progressing cavity pumps is for liquid transfer using either a constant speed or a variable speed drive. These pumps adapt well to many speciality applications, such as handling abrasive, viscous and two-phase fluids. Progressing cavity pumps can be employed for pumping fluids with viscosity less than 1 CentiPoise.

For background information relating to progressing cavity pumps, reference may be had to the following previously issued United States patents:

| U.S. Pat. No. | INVENTOR | TITLE |
|---|---|---|
| 3652192 | Kramer et al | Sealed Conveying Apparatus |
| 3802803 | Bogdanov et al | Submersible Screw Pump |
| 3912426 | Tschirky | Segmented Stator For Progressive Cavity Transducer |
| 3982858 | Tschirky | Segmented Stator For Progressive Cavity Transducer |
| 4104009 | Chanton | Screw Pump Stators |
| 4207037 | Riordan | Stator For A Downhole Fluid Operated Motor and Method Of Assembling The Same |
| 4211521 | Streicher | Eccentric Disc Pump |
| 4711006 | Baldenko et al | Downhole Sectional Screw Motor, Mounting Fixture Thereof and Method of Oriented Assembly Of Working Members Of The Screw Motor Using The Mounting Fixture |
| 5417281 | Wood et al | Reverse Moineau Motor and Pump Assembly For Producing Fluids From A Well |

Progressing cavity pumps typically include a rotor configured with a single screw thread of streamlined design, that is without sharp edges, functioning inside a stator having a cavity, the wall of which defines an elongated double helix. While the stator can be formed of metal, a most common method of manufacturing progressing cavity pumps is to make the stator of elastomeric material. The combination of a metallic rotor and elastomeric stator functions advantageously to provide a pump having great capacity to pump abrasive fluids and to maintain a predetermined discharge pressure. When pumps are required to handle abrasive fluids or to run continuously for long periods, wear of the walls of the stator cavity occurs and in most applications it is necessary to periodically replace the stator. Typically the maximum pressure that a progressing cavity pump can deliver is directly related to the length of the rotor and stator and accordingly, in some applications the rotor and stator can be relatively long compared to their diameters. The cost of manufacturing a long elastomeric stator having the complex double helix cavity can be significant. For this reason, a method has evolved in which the stator is formed of a series of shorter length stator segments positioned within a pump barrel. It is to this innovation that this invention is concerned.

This disclosure provides a stator assembly for progressing cavity pumps utilizing a plurality of elastomeric stator segments and having improved spacers for receiving and supporting the stator segments.

BRIEF SUMMARY OF THE INVENTION

A stator assembly for use in a progressing cavity pump is provided. The stator assembly includes, as basic elements: a tubular pump barrel; a plurality of cup-like spacers slidably positioned in the pump barrel; and an elastomeric stator segment housed in each of the spacers. Additionally, stator lock nuts or other tubular elements are provided to capture a series of spacers and stator segments within a pump barrel.

More particularly, the stator assembly for use in a progressing cavity pump includes a tubular pump barrel having an inlet and an outlet end, at least a portion spaced between the inlet and outlet ends, having a uniform internal diameter. A plurality of elastomeric stator segments are removably positioned serially within the pump barrel uniform internal diameter portion. Each stator segment has an inlet and an outlet end and each has adjacent to its outlet end a circumferential external lip portion. Each stator segment has a contoured opening therethrough generally coaxial with the pump barrel, the openings of the plurality of stator segments being in general axial alignment and adaptable to rotatably receive a progressing cavity rotor therein.

A tubular spacer is provided for each of the stator segments. Each spacer is slidably receivable in the pump barrel uniform internal diameter portion and each has at its outlet end a circumferential edge and at its inlet end an inwardly extending annular flange. Each stator segment is received in a tubular spacer with the stator segment circumferential lip being captured between the circumferential edge of the spacer within which it is received and the flange portion of a next adjacent spacer.

A tubular inlet closure is threadably secured within the pump barrel adjacent the inlet end thereof and a tubular outlet closure received within the pump barrel adjacent the outlet end, the tubular spacers having the stator segments therein being captured between the inlet and outlet closures.

A better and more complete understanding of the invention will be obtained from the detailed description of the preferred embodiments, taken in conjunction with the attached drawings.

DETAILED DESCRIPTION OF THE PREFERRED EMBODIMENTS

Figure 1:
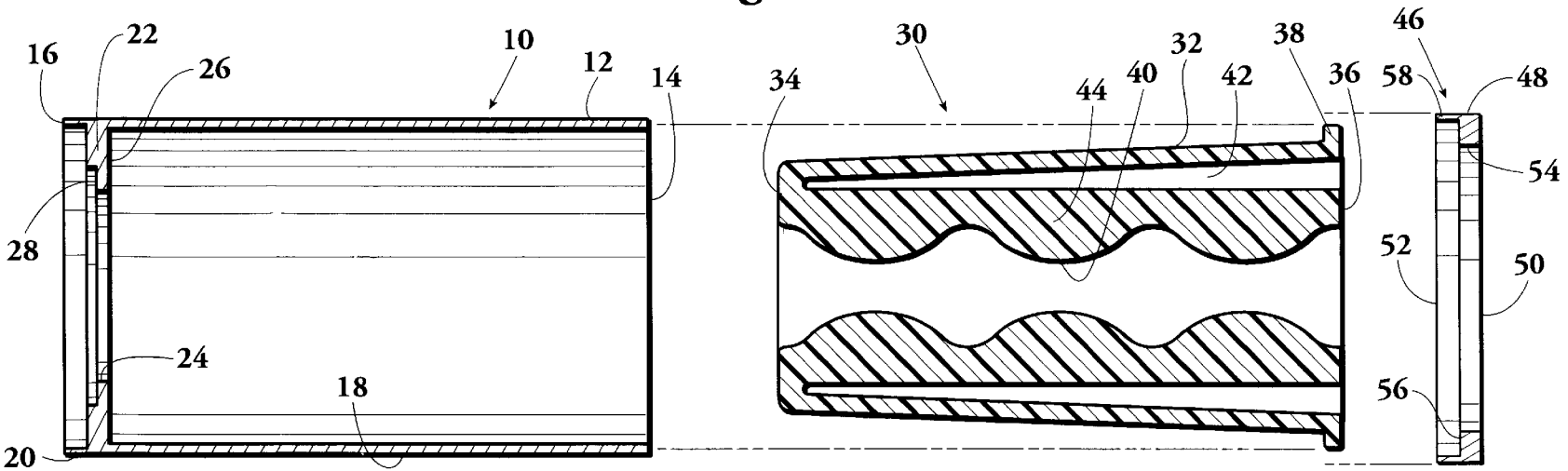
FIG. 1 is an exploded view of a spacer, a stator segment and a discharge spacer ring that together are assembled in a tubular pump barrel to form the stator assembly of a progressing cavity pump.

Referring to the drawings and first to FIG. 1, the essential elements making up a stator assembly for a progressing cavity pump are shown in an exploded cross-sectional view.

A cup-like tubular spacer indicated by the numeral 10 is formed of metal and has a tubular sidewall 12 that provides, at the fluid outlet end, a circumferential lip 14. Opposite to circumferential lip 14 is a fluid inlet end 16. Spacer 10 has a cylindrical external wall 18 dimensioned to slidably and snugly fit within a tubular pump barrel as will be described subsequently. The inlet end 16 of spacer 10 is defined by an integrally formed circumferential lip 20 that is of a thickness less than that of sidewall 12.

Integrally formed with spacer sidewall 12 is an inwardly extending integral annular flange 22 having an axial opening 24 therein. Flange 22 provides an annular internal shelf 26 that includes, in the surface thereof opposite shelf 26, an annular recess 28 surrounding opening 24.

Received within the cup-like spacer 10 is an elastomeric stator segment generally indicated by the numeral 30. Stator segment 30 is integrally formed of elastomeric material, such as natural rubber, synthetic rubber, urethane or various other elastomeric plastics. Stator segment 30 has a frustoconical exterior surface 32 providing an inlet end 34 and outlet end 36. At outlet end 36 is an integrally formed radially outward extending circumferential lip 38.

Extending through stator segment 30 is a contoured cavity 40, the shape of which is generally a smooth double helix, that is, a streamline thread pattern forming a double helix. Cavity 40 is configured to receive a rotor (not shown) having an external surface defined by a single helix. The configuration of contoured cavity 40 is well known to practitioners in the art of designing and manufacturing progressing cavity pumps; therefore, the specific configuration of cavity 40 is not an element of the present invention. A rotor (not illustrated) that is receivable within cavity 40 rotates eccentrically and therefore stator segment 30 is designed to provide flexibility. Increased flexibility is achieved by an elongated circumferential annulus 42 is formed in the stator segment, the annulus extending from outlet end 36 to adjacent inlet end 34, the annulus surrounding stator segment integral central portion 44, that is, the portion that has contoured cavity 40 therein.

Also shown in FIG. 1 is a discharge spacer ring 46 that has a cylindrical external surface 48, an outlet end 50 and an inlet end 52. Discharge spacer ring 46 has a central opening 54 therein and an enlarged internal diameter circumferential recess 56 providing an integral circumferential lip 58. The function of the discharge spacer ring 46 will be described subsequently.

Figure 2:
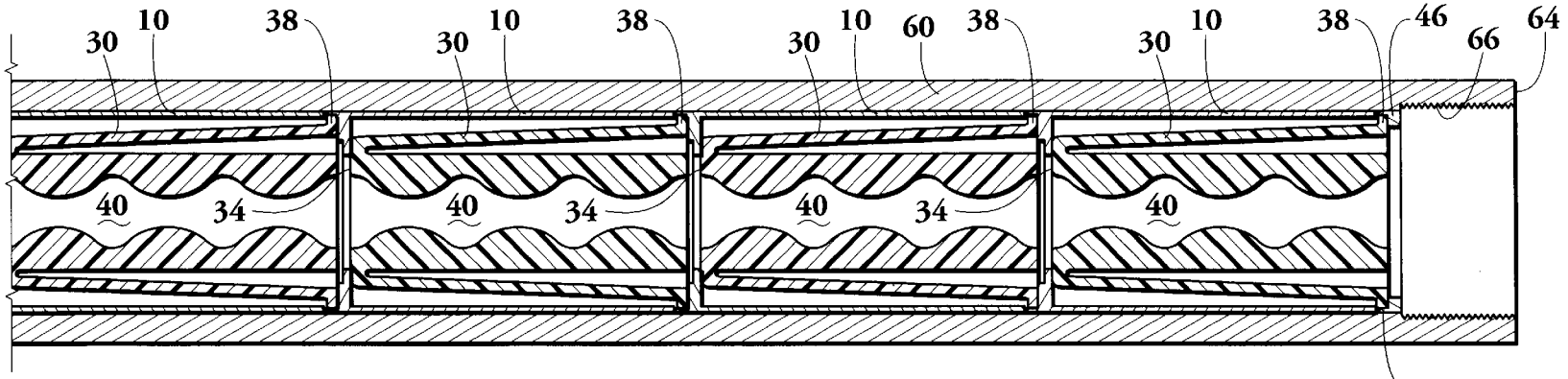
FIG. 2 is a cross-sectional view of a portion of a pump barrel having a series of spacers and stator segments therein that form a stator assembly for a progressing cavity pump.
Figure 4:
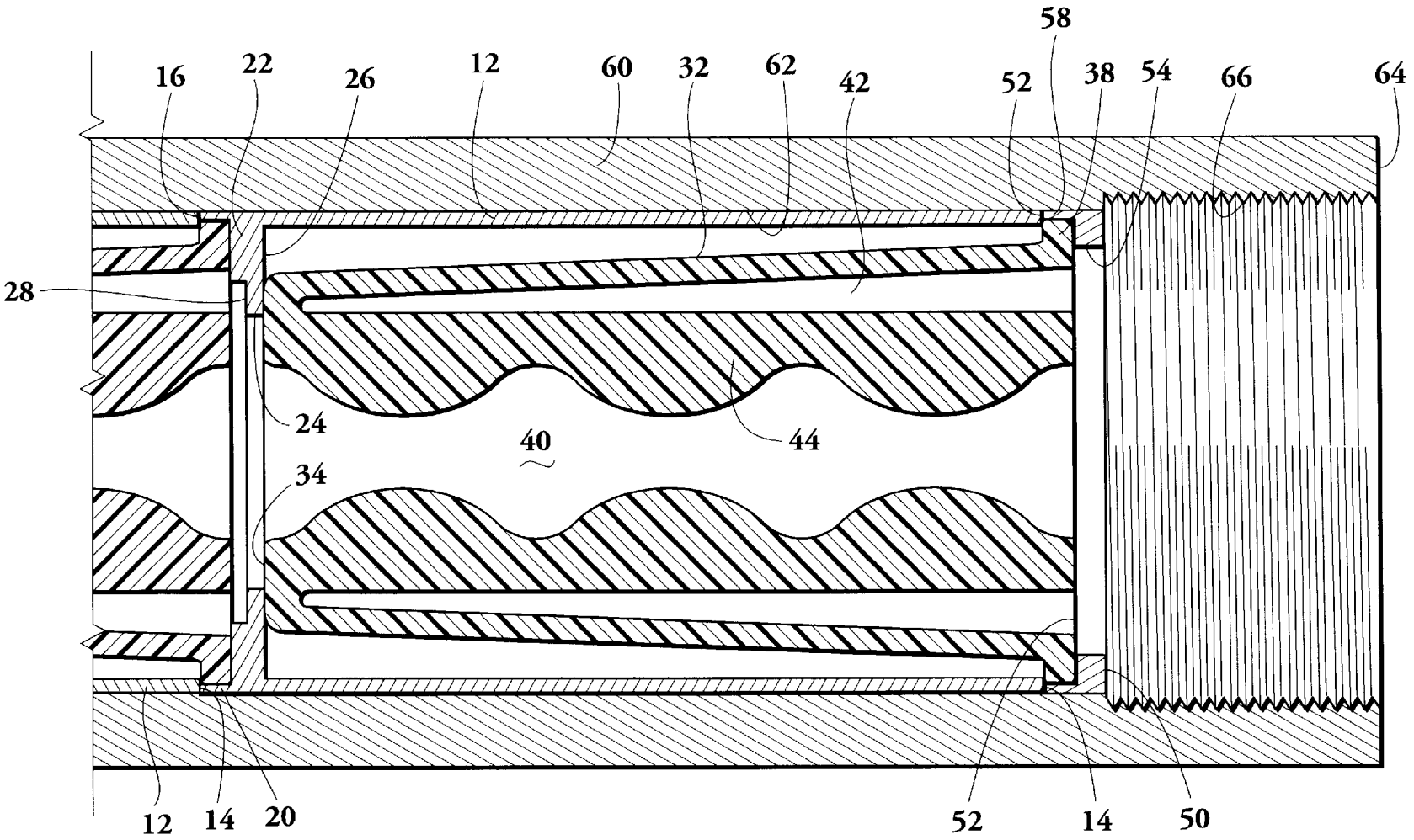
FIG. 4 shows: a full cross-sectional view of a cup-like tubular spacer, the upper end of a second, adjacent spacer; a full cross-sectional view of an elastomeric stator segment; a partial view of an adjacent stator segment; and a discharge spacer ring, all as positioned within the outlet end portion of a pump barrel.

FIGS. 2 and 4 show portions of a stator assembly employing spacers 10, stator segments 30 and a discharge spacer ring 46. The stator assembly includes an elongated tubular pump barrel 60 having an internal uniform diameter cylindrical surface 62. Pump barrel 60 has a fluid outlet end 64, the fluid inlet end being at the opposite end of the barrel and not seen in the figures. Telescopically received within pump barrel 60 are a series of spacers 10 and stator segments 30, four sets of spacers and stators being shown in FIG. 2 while the enlarged view of FIG. 4 shows one complete spacer and stator segment combination and a portion of another. Each spacer 10 receives therein a stator segment 30. The integral lip 38 of each stator segment 30 is received within a circumferential lip 20 integrally extending from the inlet end of a spacer 10, except for the stator segment adjacent the pump barrel outlet 64 in which case the lip portion 38 of this stator segment is received within the circumferential lip 58 of discharge spacer ring 46.

Barrel 60 is shown internally threaded at 66 adjacent outlet end 64 and receives an externally threaded annular retainer 68 (seen only in FIG. 3) which engages the discharge spacer ring 46 to thereby retain the series of spacers and stator segments in locked position within barrel 60. The dimensional relationship between the thickness of the spacer wall 12 and the thickness of the lip portion 20 of each spacer is important in that such thickness differential provides an internal circumferential ledge supporting the lip portion 38 of each stator segment. In like manner, the thickness of lip 38 of discharge spacer ring 46 is reduced compared to the thickness of the sidewall 12 of a spacer to support lip 38 of the stator segment next adjacent the pump barrel outlet end 64.

The bottom surface at the inlet end 34 of each of the stator segments 30 rest on an annular shelf 26 provided by the integral internal flange portion 22 of each of spacers 10. Thus each stator segment is supported by a cup-like spacer and held in alignment within barrel 60. Further, the number of such spacer/stator segment combinations can be varied in accordance with the length of barrel 60 which, in turn, is directly related to characteristics desired of the progressing cavity pump. As an example, when a higher fluid pressure is required, generally an increased number of spacer/stator segment combinations are employed in the pump design.

Figure 3:
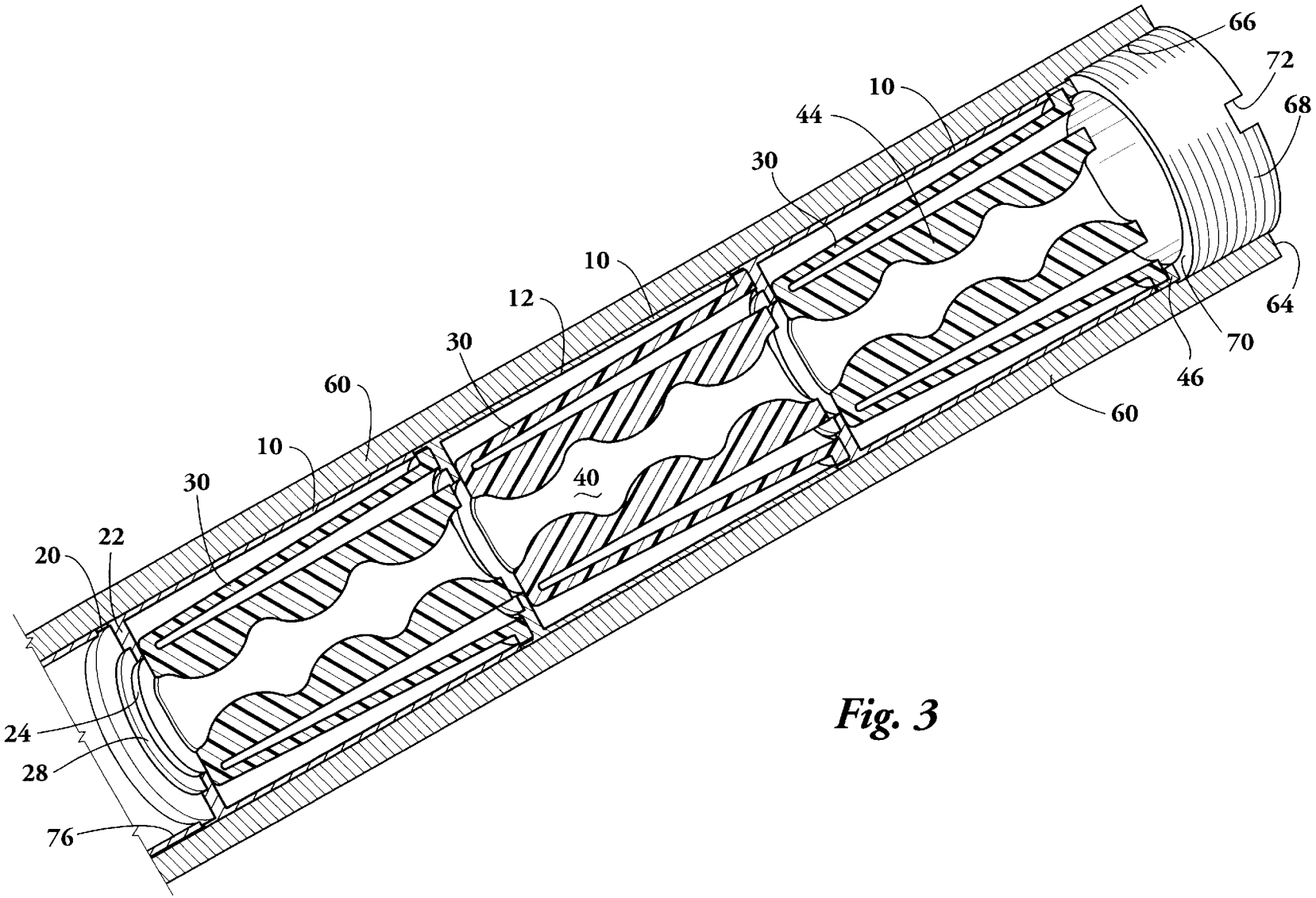
FIG. 3 is an isometric, cross-sectional view of a pump barrel having three stator segments therein.

Referring to the cross-sectional isometric view of FIG. 3, at the outlet end portion 64 of pump barrel 60, received in threaded portion 66, is a tubular externally threaded lock nut 68. The inner annular end surface 70 of the lock nut engages the outlet end 50 of a discharge spacer ring 46. Indentations 72 (only one of which is seen) in the outer tubular end of lock nut 68 provides a means of threadably inserting it into and removing it from the pump barrel. With lock nut 68 removed, each spacer 10, each with a stator segment 30 therein, can be removed from the interior of the barrel. Worn or damaged stator segments 30 can thus be easily removed and replaced. This illustrates the expeditious, convenient and economical way of providing a reconditioned stator assembly for a progressing cavity pump. By the use of relatively short length spacers 10 and matching stator segments 30, a stator assembly can be made up to match the required length of a progressing cavity pump.

The inlet end portion of pump barrel 60 (as seen in FIG. 3) shows part of a spacer tube 76 positioned in the barrel, the upper end of the spacer tube engaging lip 20 of a spacer 10 so as to retain the first spacer and its included stator segment in the inlet end of the pump. The length of spacer tube 76 can vary. The lower end of the pump barrel is typically affixed to an intake housing (not shown) which, in turn, is attached to a motor housing or a bearing housing (also not shown).

Thus it can be seen that the serial arrangement of spacer/stator segments within pump barrel 60 is captured between spacer tube 76 and lock nut 68.

The stator assembly as illustrated and described herein employs a minimum number of basic components irrespective of the length of the stator assembly. These basic components include a pump barrel 60, a plurality of spacers 10, and a plurality of stator segments 30. To maintain the spacer/stator segments within the barrel, a discharge spacer ring 46 is employed at the barrel outlet end together with a locking nut 68 and, at the inlet end, a sleeve 76. The stator assembly is expeditiously dismantled for replacement of worn stator segments.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A stator assembly for use in a progressing cavity pump comprising:

a tubular pump barrel having an inlet and an outlet end at least a portion spaced between the inlet and outlet ends that is of uniform internal diameter;

a plurality of elastomeric stator segments removably positioned serially within said pump barrel uniform internal diameter portion, each having an inlet and an outlet end and each having adjacent its outlet end a circumferential external radial lip, each stator segment having a contoured opening therethrough generally coaxial with said pump barrel, the openings of the plurality of stator segments being in general axial alignment and adaptable to rotatably receive a progressing cavity rotor therein;

a tubular spacer for each of said stator segments, each spacer being telescopically and removably received in said pump barrel uniform internal diameter portion and each having an outlet end providing a circumferential lip and each having an inlet end and an inwardly extending annular flange adjacent the inlet end, each stator segment being received in a tubular spacer with said stator segment circumferential lip being captured between a said circumferential lip of said spacer within which it is received and a said annular flange of a next adjacent spacer; and an inlet closure received with said pump barrel adjacent said inlet end and an outlet closure received within said pump barrel adjacent said outlet end, said tubular spacers having said stator segments therein being captured between said inlet and outlet closures.

2. A stator assembly for use in a progressing cavity pump comprising:

a tubular pump barrel having an internal cylindrical surface, an inlet end and an outlet end;

a plurality of cup-like spacers slidably and serially received end-to-end within said pump barrel internal cylindrical surface, each spacer having a tubular wall, an inlet end having an internally extending annular flange portion with an axial opening therethrough and an outlet end defined by a circumferential edge of the tubular wall; and an elastomeric stator segment housed in each said spacer, each stator segment having an inlet end and an outlet end, each stator segment having adjacent the outlet end a circumferential external lip portion and each having a contoured cavity therethrough generally coaxial with said pump barrel and adaptable to rotatably receive a progressing cavity rotor therein, the lip portion of at least some of the stator segments being captured between a said spacer outlet end circumferential edge and a said spacer inlet end.

3. A stator assembly for use in a progressing cavity pump according to claim 2 including a first retainer received within said pump barrel adjacent said inlet end and a second retainer received within said pump barrel adjacent said outlet end, said spacers having said stator segments therein being captured between the first and second retainers.

4. A stator assembly for use in a progressing cavity pump according to claim 2 wherein said each of stator segments is dimensioned in length such that said inlet end thereof rests on a said annular flange portion of a said spacer in which the stator segment is housed.

5. A stator assembly for use in a progressing cavity pump according to claim 2 wherein each of said stator segments includes an integral central portion surrounded by an integral outer circumferential portion from which said circumferential lip portion extends and wherein said inlet end of each of said spacers has, in said annular flange, a central annular portion forming an annular recess in said spacer inlet end, the annular recess serving to prevent interference with movement of said stator segment central portion.

6. A stator assembly for use in a progressing cavity pump according to claim 2 wherein each said spacer inlet end includes an integral circumferential annular lip portion extending away from said annular flange portion as an extension of said tubular wall, the annular lip portion having a thickness less than said tubular wall, the annular lip portion being engaged by said outlet end circumferential edge of a next adjacent spacer, a said stator segment lip portion being received within said spacer annular lip portion.

7. For use in a stator assembly of a progressing cavity pump of the type that has a tubular pump barrel with an inlet end and an outlet end, the pump barrel providing an internal cylindrical wall, the stator assembly employing a plurality of elastomeric stator segments positioned serially in end-to-end relationship within the pump barrel, a cup-like spacer for each of the stator segments comprising:

a cup-like spacer having a tubular wall with an inlet end and an outlet end, the spacer being dimensioned to slidably fit within a progressing cavity pump tubular barrel, the tubular wall providing at the spacer member outlet end a circumferential lip, and including an internal integral flange portion adjacent to said inlet end having an axial opening therethrough, the flange portion providing an internal radial support surface within said tubular wall, the spacer member being dimensioned to receive an elastomeric stator element therein resting on the radial support surface.

8. A spacer member for use in a stator assembly of a progressing cavity pump according to claim 7 including an integral annular lip portion at said spacer member inlet end of external diameter commensurate with said tubular wall, the annular lip portion extending from said internal flange portion, the radial thickness of the lip portion being less than the thickness of said tubular wall, the annular lip portion serving to engage a said circumferential lip of an adjacent spacer member as spacer members are mounted serially within a progressing cavity pump tubular barrel.

9. A spacer member for use in a stator assembly of a progressing cavity pump according to claim 7 wherein said integral internal flange portion has an exterior surface in the direction of said spacer member inlet end, the exterior surface being defined in part by an annular recess surrounding said axial opening, the annular recess providing space for receiving a flexible center portion of an elastomeric stator supportable in an adjacently positioned spacer.

* * * * *